United States Patent [19]

Lefebvre et al.

[11] 3,983,722

[45] Oct. 5, 1976

[54] APPARATUS FOR THE CONTINUOUS TREATMENT OF THREADS

[75] Inventors: Michel S. M. Lefebvre, Saint Quentin; Jean-Claude M. L. Hennion, Arly, both of France

[73] Assignee: Omnium de Prospective Industrielle, France

[22] Filed: Feb. 25, 1974

[21] Appl. No.: 445,332

Related U.S. Application Data

[60] Continuation-in-part of Ser. No. 307,763, Nov. 20, 1973, Pat. No. 3,837,186, which is a division of Ser. No. 107,166, Jan. 18, 1971, Pat. No. 3,724,088.

[30] Foreign Application Priority Data

Feb. 28, 1973 France ..... 73.06996

[52] U.S. Cl. ..... 68/3 SS; 68/20; 68/DIG. 1

[51] Int. Cl.[2] ..... D06B 3/04; D06B 15/00; D06B 21/00

[58] Field of Search ..... 68/3 SS, DIG. 1, 20, 68/9, 5 D, 5 E, 181 R; 34/16, 15; 28/1.4

[56] References Cited

UNITED STATES PATENTS

| | | | |
|---|---|---|---|
| 1,595,483 | 8/1926 | Minton | 34/16 |
| 2,194,565 | 3/1940 | Moss | 34/16 |
| 2,398,856 | 4/1946 | Reel | 68/9 X |
| 2,509,279 | 5/1950 | Sisson | 68/20 X |
| 2,642,035 | 6/1953 | McDermott | 68/181 R X |
| 3,724,088 | 4/1973 | Lefebvre et al. | 34/16 |
| 3,731,395 | 5/1973 | Watanabe | 68/DIG. 1 |
| 3,739,604 | 6/1973 | O'Toole et al. | 68/3 SS |
| 3,743,328 | 7/1973 | Longfellow | 138/122 |
| 3,837,186 | 9/1974 | Lefebvre et al. | 68/3 SS |

*Primary Examiner*—Philip R. Coe
*Attorney, Agent, or Firm*—Fitzpatrick, Cella, Harper & Scinto

[57] ABSTRACT

In apparatus for continuously treating a thread, for example a textile thread, including squeezing and/or drying a humid thread wherein the humid thread is passed into a zone traversed by a current of air at a pressure lower than that prevailing about the thread during the operation that provoked its humidification, the zone comprises a chamber having an inlet and an outlet between which there is a helical conduit.

3 Claims, 2 Drawing Figures

APPARATUS FOR THE CONTINUOUS TREATMENT OF THREADS

Figure 1:
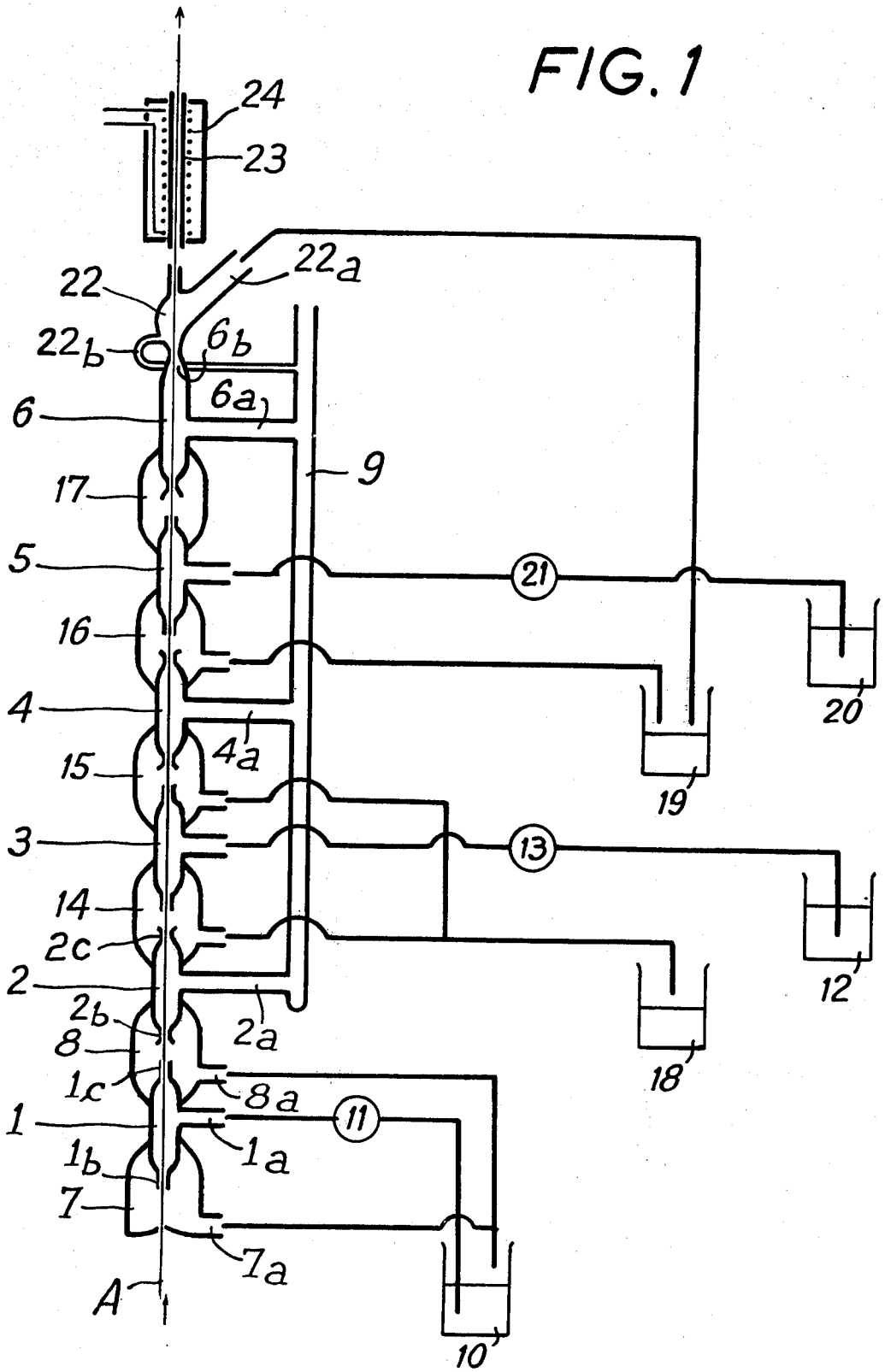

This application relates to the continuous treatment of threads and, more particularly, to apparatus for drying linearly advancing threads and is a continuation-in-part of copending application Ser. No. 307,763 filed Nov. 20, 1973, now U.S. Pat. No. 3,837,186, as a division of application Ser. No. 107,666 filed Jan. 18, 1971, now U.S. Pat. No. 3,724,088.

It is known that textile threads can be subjected, after spinning, to various treatments, for example dyeing or coating. These treatments are carried out on bobbins of threads, though sometimes on skeins, but their efficiency does not always provide the desired homogeneity.

However, different processes are known for subjecting threads to certain treatments during continuous travel of these threads. Such continuous treatments generally comprise deposition of a product on the thread to be treated, for example by passing the thread through a bath, then eliminating the excess treatment fluid, for example, by means of a current of air circulating in the region of the thread.

However, it has to be taken into account that the known continuous treatment of threads up to now do not allow of an accurate dosage of the quantity of deposited product nor an acceptable penetration of this product into the thread. This was due particularly to the fact that the squeezing and, ultimately, the drying of the thread by the current of air was insufficient.

The invention described in application Ser. No. 307,763 has as its object to overcome these difficulties and describes a process for squeezing and/or drying a wet thread, particularly a textile thread, for use particularly in the course of a treatment, such as dyeing effected in a continuous manner on the thread. The wet thread is passed through a zone traversed by a current of air at a pressure much below the pressure existing around the thread during the operation giving rise to the wetness of the thread. The low pressure zone is created in the supersonic flow of a current of air at the outlet of a convergent-divergent nozzle through which the thread is passed.

There is also described in that application, an apparatus for carrying out the above process comprising at least two elementary treatment chambers between which is provided a zone for recovery of treatment fluids. Each treatment chamber comprises two orifices for the entry and the exit of the thread and is coupled to a conduit for feeding treatment fluids.

Each treatment chamber fed by an active chemical fluid is followed by a chamber which is fed by an inert gas, such as compressed air, and which squeezes and/or dries the thread.

It is an object of the present invention to provide improvements in the above apparatus in order to improve the quality of the treated thread. To this end, one at least of the treatment chambers includes between its entry and exit orifices a part formed by a helical conduit.

Figure 2:
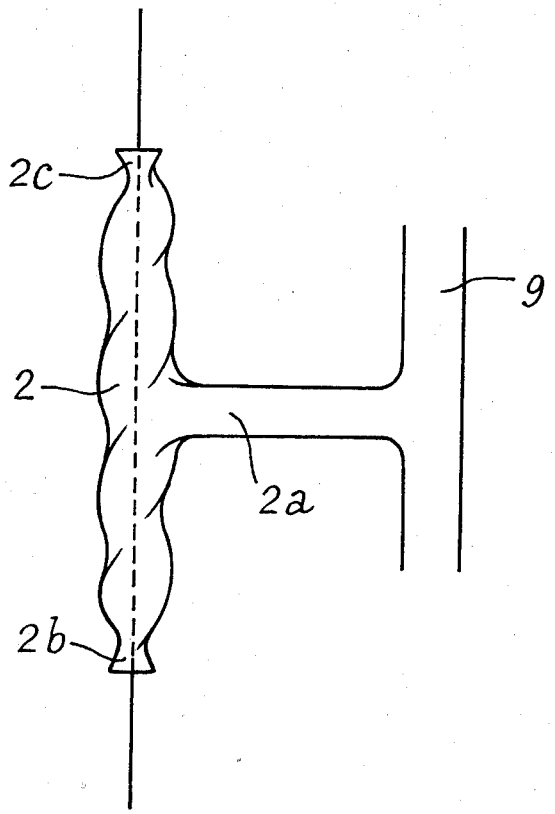

Specific embodiments of the invention have been chosen for purposes of illustration and description, and are shown in the accompanying drawings, forming a part of the specification, wherein:

FIG. 1 is a schematic view illustrating chambers according to the present invention in their operational environment; and FIG. 2 is a detail view of one such chamber.

Referring now to FIG. 1 of the accompanying drawing, there is shown apparatus for the continuous treatment of threads as disclosed in the aforementioned patents. Thus, the apparatus according to FIG. 1 includes elementary treatment chambers 1, 2, 3, 4, 5 and 6 aligned along the path followed by the thread A.

The chamber 1, corresponding to the attack by the acid bath comprises a pipe 1*a* connected to a tank 10 of acid solution, by means of a pump 11. The two apertures 1*b* and 1*c* of this chamber are capillary tubes whose diameter, a function of that of the thread to be treated, is determined so as to avoid, or at least limit, the leaks of liquid by gravity or by drive. The pump 11 maintains a constant level of liquid in the chamber 1.

On either side of the treatment chamber 1 are disposed two recuperation chambers 7 and 8. They respectively surround, in sealed manner, the apertures 1*b* and 1*c* and have pipes 7*a* and 8*a* ensuring the recovery of the leakage liquid which is returned to the tank 10.

The treatment chambers 2, 4 and 6 correspond to intermediate squeezing and possibly drying phases. Their ends are of course also surrounded in sealed manner by the recovery chambers 8, 14, 15, 16, 17 and 22. In this case, however, the treatment fluid is compressed air passed through a main pipe 9 and terminating at the pipes 2*a*, 4*a*, 6*a* belonging to each of said chambers. It should be emphasized that the inlet and outlet apertures of these chambers 2, 4 and 6 are each in the shape of a convergent-divergent nozzle, reference 2*b* and 2*c* for the chamber 2.

The convergent-divergent nozzles of chambers 2, 4 and 6 are fed upstream by a pressure higher than or at least equal to the "critical" pressure at the constriction of the nozzle. It will be recalled on this subject that critical pressure designates the pressure prevailing at the constriction of a nozzle and from which a supersonic flow is obtained in the divergent part of the nozzle, although the flow is subsonic in the convergent part thereof.

The nozzles used in the apparatus according to the invention are preferably set out according to known methods, so that, when they exist, the shock waves provoked by the return of the air to a subsonic speed are located outside the divergent part and not, as is frequently the case, inside said latter.

Referring now to FIG. 2, there is shown an embodiment of the invention wherein the chamber 2 comprises a conduit 2*a* coupled to a principal conduit 9 for feeding compressed air. The orifices 2*b* and 2*c* for entry and exit of the thread in this chamber are formed each by a convergent-divergent nozzle and they are fed upstream by a pressure at least equal to the critical pressure at the neck of the nozzle. The function of these nozzles has already been described in the aforesaid patents and will not be repeated here.

The central part of the treatment chamber, which has te form of a conduit, is provided by a helical conduit. To this end, the tube forming the chamber may be twisted, the deformation of the walls providing along the axis of the two orifices a rectilinear zone allowing the passage of the thread. This zone must in general terms be dimensioned so that the thread, travelling at considerable speed, does not come into contact with the walls of the chamber.

The treatment chamber can, of course, be twisted either left hand or right hand, that is to say, in the form of S or of Z.

The action of a treatment fluid under pressure on a textile thread, particularly where it comprises discontinuous fibers, always has the effect of detaching at least partially the superficial fibers. Not only does this action decrease the characteristics of the thread, but according to the type of thread, can cause detachment of fibrils and cause deposits in the apparatus. It can also cause wadding along the length of the thread, resulting in poor homogeneity and difficulties in applying later treatments.

In using treatment chambers according to the invention, a supplementary helical movement is imparted to the treatment fluid around the thread, which avoids detachment of fibrils and, on the contrary, holds them in homogeneous fashion on the thread, by a superficial false torsion effect. The chamber has an S or Z torsion effect, according to the thread to be treated, where this exhibits an initial torsion effect.

It is evident that such an improvement is particularly useful for chambers fed by compressed air and does not harm the squeezing and/or drying of the thread, but following the applications envisaged and the type of thread treated, it may be necessary to provide the same improvement for the chambers fed with a treatment fluid such as a dye.

We claim:

1. In apparatus for continuous treatment of a thread during rectilinear displacement therethrough which comprises:

means for treating the thread with a liquid;

at least one treatment chamber having inlet and outlet means adapted to receive said thread, said inlet and outlet means comprising convergent-divergent nozzles arranged in alignment with said means for treating the thread with a liquid;

conduit means for connecting said treatment chamber at a location intermediate its ends to a source of compressed inert gas;

a recovery chamber interconnecting said treatment chamber and said means for treating the thread with a liquid; and conduit means connected to said recovery chamber and adapted to remove liquid therefrom;

the improvement wherein said treatment chamber includes between its inlet and outlet means a part constituted by a helical conduit.

2. Apparatus according to claim 1, comprising a plurality of alternating aligned liquid treatment chambers and gas treatment chambers, each of said chambers being interconnected by a recovery chamber.

3. Apparatus according to claim 1, wherein said treatment chamber is formed by a tube twisted about its own longitudinal axis along at least a part of its length.

* * * * *